US006055947A

United States Patent [19]

Okuno

[11] Patent Number: 6,055,947

[45] Date of Patent: May 2, 2000

[54] ENGINE COOLING WATER CONTROL SYSTEM

[75] Inventor: Tatsujiro Okuno, Kanagawa, Japan

[73] Assignee: Tosok Corporation, Zama, Japan

[21] Appl. No.: 09/231,868

[22] Filed: Jan. 14, 1999

[51] Int. Cl.[7] ..... F01P 7/02

[52] U.S. Cl. ..... 123/41.13; 123/41.05

[58] Field of Search ..... 123/41.13, 41.05, 123/41.1

[56] References Cited

U.S. PATENT DOCUMENTS

| | | | |
|---|---|---|---|
| 2,656,825 | 10/1953 | Hartz | 123/41.13 |
| 2,897,801 | 8/1959 | Kloss | 123/41.13 |
| 4,011,032 | 3/1977 | Steinwart et al. | 418/84 |
| 4,325,330 | 4/1982 | Kugler et al. | 123/41.13 |
| 4,399,774 | 8/1983 | Tsutsumi | 123/41.1 |
| 4,538,553 | 9/1985 | Kurz et al. | 123/41.13 |
| 4,567,858 | 2/1986 | Hayashi | 123/41.13 |
| 4,875,437 | 10/1989 | Cook et al. | 123/41.1 |
| 5,390,632 | 2/1995 | Ikebe et al. | 123/41.02 |
| 5,404,842 | 4/1995 | Matsushiro et al. | 123/41.13 |

*Primary Examiner*—Willis R. Wolfe
*Assistant Examiner*—Jason Benton
*Attorney, Agent, or Firm*—Oblon, Spivak, McClelland, Maier & Neustadt, P.C.

[57] ABSTRACT

The engine driving condition is separated into regions A, B and C. The region A is a region indicative of a high load condition. The region B is a region indicative of a low load condition. The region C is region indicative of an idle condition. Control objective temperatures in the respective driving conditions are set to 80, 110 and 95 degrees centigrade for the regions A, B and C, respectively. This enables control of cooling water temperature within the engine to be provided in a manner more adapted for the respective engine driving conditions.

9 Claims, 5 Drawing Sheets

ENGINE COOLING WATER CONTROL SYSTEM

BACKGROUND OF THE INVENTION

1. Field of the Invention

The present invention relates to an engine cooling water control system.

2. Description of the Related Arts

In conventional automotive engine cooling water control systems for example, the temperature of cooling water within the engine is controlled to a control objective temperature which has previously been set in conformity with the driving condition such as engine load or engine speed.

FIG. 4 illustrates a schematic configuration of an automotive engine cooling water control system. The automotive engine cooling water control system has a structure in which a cooling water control valve 21 opens in response to a control signal from an ECM 20, allowing cooling water which has been deprived of heat by a radiator 22 to be circulated by a water pump 23 through an inlet flow passage 24 into a water jacket 25 of the engine, the cooling water cooling a cylinder block 26 and a cylinder head 27 and thereafter being returned through an outlet flow passage 28 to the radiator 22 for radiation, the cooling water being again circulated into the water jacket 25. The cooling water flow passage within the water jacket 25 further includes a bypass flow passage 29 and a heater flow passage 31. The bypass flow passage 29 allows cooling water which has been warmed as a result of cooling the cylinder block 26 and the cylinder head 27 to again circulate into the water jacket 25 to thereby reduce variations in water temperature and water pressure. The heater flow passage 31 allows a circulation of cooling water between the water jacket 25 and a heater 30 for warming the automobile interior space in the cold. The heater flow passage 32 is provided with a heater cut valve 32 for cutting off the flow of cooling water if necessary.

In such a cooling water control system the temperature of cooling water within the engine is detected by a water temperature sensor so that the valve opening of the cooling water control valve 21 is regulated depending on the detected temperature to provide a control of the circulation flow rate of cooling water to the radiator 22, thereby controlling the temperature of the cooling water within the engine to a predetermined control objective temperature. At that time, the control objective temperature is set in compliance with the driving condition such as the engine load or engine speed to thereby improve the fuel efficiency, exhaust performance and drive performance. In other words, the known system attempts to improve the engine power and to secure the reliability in the high load engine driving condition whereas it attempts to achieve a reduction in friction and an improvement in combustion in the low load engine driving condition.

Its outline will hereinafter be described. Referring to FIG. 5 there is illustrated a relationship among the engine speed, torque and accelerator opening (Road, load line: RL) in the respective engine driving conditions which are largely separated into regions A and B. The region A denotes a high load condition in which the torque value is high relative to the engine speed with a large accelerator opening. The region B is a one indicative of a low load condition in which the torque value is lower than in the region A relative to the engine speed and in which the torque value decreases accordingly as the engine speed rises with a gently increased accelerator opening for a gentle acceleration. Then, in the ECM 20 the control objective temperature is set to a high temperature (e.g., 110 degrees centigrade) when the driving condition is in the region B whereas it is set to a low temperature (e.g., 85 degrees centigrade) when the driving condition is in the region A, in response to which the cooling water control value 21 is opened or closed to control the amount of circulation of the cooling water.

However, even though the driving condition of the engine has been separated into the high load condition (region A) and the low load condition (region B) as described above to set separately different control objective temperatures, it will be impossible to effect instantaneous replacement of cooling water within the water jacket 25 with cooling water within the radiator 22 when for example the control objective temperature of the cooling water within the engine has been switched from high temperature to low temperature. For this reason, the cooling water within the engine takes much time to lower its temperature, resulting in a poor responsibility upon the switching control of the cooling water temperature within the engine, which will put obstacles to improvement in the fuel efficiency, power, reliability, etc.

In case of the one having the configuration shown in FIG. 4 in particular, cooling water circulated through the bypass flow passage 29 will raise the temperature of cooling water flowing from the radiator 22 into the water jacket 25, which also makes the lowering of the cooling water temperature within the engine quite time consuming. Thus, it caused a further lowering of the responsibility upon the switching control of the cooling water temperature within the engine.

SUMMARY OF THE INVENTION

The present invention was conceived in view of the above problems involved in the prior art. It is therefore the object of the present invention to provide an engine cooling water control system ensuring an improved responsibility upon the switching control of the cooling water temperature within the engine in conformity with the engine driving conditions.

According to a first aspect of the present invention, in order to solve the above problems, there is provided an engine cooling water control system for controlling the temperature of cooling water within an engine to a control objective temperature through a circulation of the cooling water between a radiator and the engine, the cooling water control system comprising control objective temperature setting means for setting the control objective temperature of the cooling water within the engine to a first control objective temperature when the driving condition of the engine is a low load condition, and to a second control objective temperature lower than the first objective temperature when the driving condition of the engine is a high load condition, and to a third control objective temperature lying between the second control objective temperature and the first control objective temperature when the driving condition of the engine is an idle condition.

Such a configuration enables the control objective temperature in the idle condition which may often occur to be suppressed lower than before through the increase in the number of control temperature objectives as compared with the prior art.

According to a second aspect of the present invention there is provided an engine cooling water control system further comprising a flow rate control valve for controlling the flow rate of cooling water circulating between the radiator and the engine; and control means for controlling the opening of the flow rate control valve so as to achieve a control objective temperature which is set by the control objective temperature setting means, the control means providing a control to fully open the flow rate control valve when the control objective temperature is set to the second objective temperature by the control objective temperature setting means.

Such a configuration allows the flow rate control valve to be fully opened when the control objective temperature of cooling water within the engine is switched from the first objective temperature to the second objective temperature, thereby increasing the amount of circulation of cooling water between the radiator and the engine, with the substitution of cooling water in the engine with cooling water in the radiator in a short time.

According to a third aspect of the present invention there is provided an engine cooling water control system further comprising a water pump allowing a circulation of the cooling water and capable of controlling its discharge pressure; and control means for increasing the discharge pressure of the water pump than before when the control objective temperature is set to the second objective temperature by the control objective temperature setting means.

Such a configuration allows the discharge pressure of the water pump to increase than before when the control objective temperature of cooling water within the engine is switched from the first objective temperature to the second objective temperature, thereby adding to the amount of circulation of cooling water between the radiator and the engine, with substitution of cooling water in the engine with cooling water in the radiator in a short time.

According to a fourth aspect of the present invention there is provided an engine cooling water control system further comprising opening/closing means for opening or closing a bypass flow passage allowing a recirculation into a water jacket of the engine of a part of cooling water which is returned to the radiator after cooling of the interior of the water jacket; and control means for causing a closing action of the opening/closing means when the engine driving condition migrates from a low load condition to a high load condition or to an idle condition.

Such a configuration allows the flow of cooling water through the bypass flow passage to be cut off when the control objective temperature is set to the low temperature side, thereby preventing a direct return into the water jacket of a part of the cooling water which has been warmed in the water jacket. For this reason, immediately after the setting of the control objective temperature to the low temperature side, the cooling water flowing into the water jacket is kept at a low temperature.

According to a fifth aspect of the present invention there is provided an engine cooling water control system further comprising opening/closing means for opening or closing a heater flow passage allowing a circulation between a water jacket and a heater of the engine; and control means for causing a closing action of the opening/closing means when the engine driving condition migrates from a low load condition to a high load condition or to an idle condition.

Such a configuration allows the flow of cooling water through the heater flow passage to be cut off when the control objective temperature is set to the low temperature side, thereby prohibiting a return into the water jacket of cooling water having a temperature closer to the temperature of the cooling water in the vicinity of the engine outlet. For this reason, the cooling water flowing into the water jacket is kept at a low temperature.

According to a sixth aspect of the present invention there is provided an engine cooling water control system further comprising a cylinder block and a cylinder head which communicate with each other and constitute a water jacket of the engine; a cylinder block outlet disposed in the cylinder block for allowing a return of interior cooling water to the radiator; a cylinder head outlet disposed in the cylinder head for allowing a return of interior cooling water to the radiator; opening/closing means for opening or closing the cylinder block outlet; and control means for causing a closing action of the opening/closing means when the engine driving condition migrates from a low load condition to a high load condition or an idle condition.

Such a configuration allows the flow of cooling water at the cylinder block outlet to be cut off when the control objective temperature is set to the low temperature side, with the result that the cooling water from the radiator flowing into the water jacket is returned via the cylinder head outlet through the outlet flow passage to the radiator. This ensures a sufficient cooling of the cylinder head having a large heating value, contributing to an improvement in the engine cooling capacity.

According to a seventh aspect of the present invention there is provided an engine cooling water control system further comprising control means for increasing air flow of a cooling fan of the radiator when the engine driving condition migrates from a low load condition to a high load condition or to an idle condition.

Such a configuration allows the air flow of the cooling fan provided in the radiator to increase when the cooling water control objective temperature is switched to a lower temperature, thereby promoting the lowering of temperature of the cooling water circulating between the engine and the radiator.

According to an eighth aspect of the present invention there is provided an engine cooling water control system further comprising control means for delaying the action of a cooling fan of the radiator when the engine driving condition migrates from a low load condition to a high load condition or to an idle condition.

Such a configuration allows cooling water within the water jacket to be recirculated into the water jacket without being cooled by the radiator, during the initial stage after the migration of the engine driving condition from a low load condition to a high load condition.

According to a ninth aspect of the present invention there is provided an engine cooling water control system further comprising control means for delaying the action of setting of the control objective temperature to the third control objective temperature effected by the control objective temperature setting means when the engine driving condition migrates from a low load condition to an idle condition.

Such a configuration allows the lowering of temperature of cooling water within the engine to be delayed through the control of the engine cooling water temperature to the first control objective temperature, during the initial stage after the migration of the engine driving condition from the low load condition to the idle condition.

DESCRIPTION OF THE PREFERRED EMBODIMENTS

Figure 1:
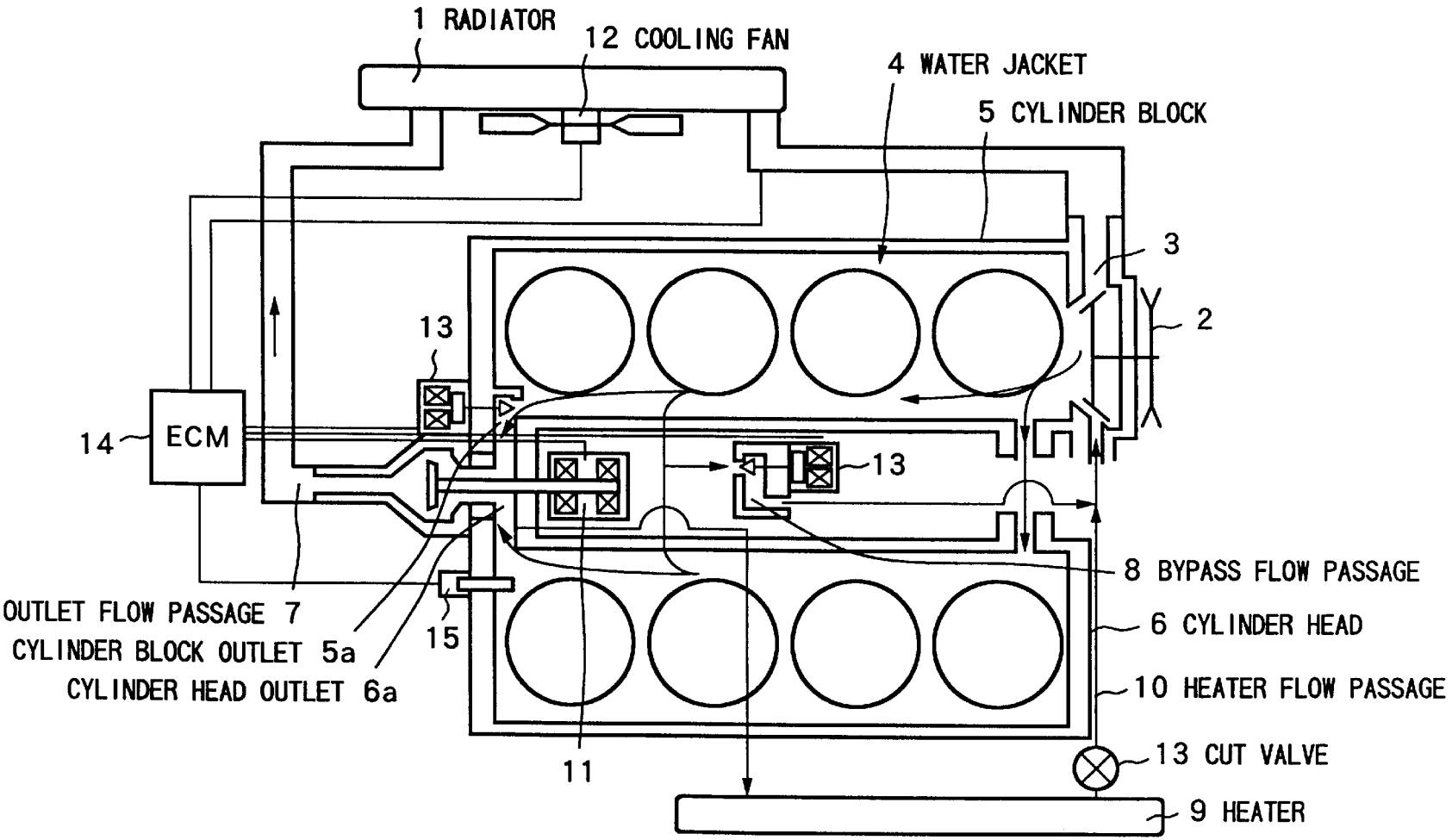
FIG. 1 illustrates a schematic configuration of an engine cooling water control system in accordance with an embodiment of the present invention.

The present invention will now be described with reference to the accompanying drawings which illustrate an embodiment thereof in a non-limitative manner. FIG. 1 illustrates a schematic configuration of an automotive engine cooling system in accordance with the present invention.

This engine cooling system has a structure in which cooling water deprived of its heat by a radiator 1 is delivered by a water pump 2 through an inlet flow passage 3 into a water jacket 4 of the engine, the cooling water warmed as a result of cooling a cylinder block 5 and a cylinder head 6 which constitute the water jacket 4 being returned from a cylinder block outlet 5*a* and a cylinder head outlet 6*a* through an outlet flow passage 7 to the radiator 1, the cooling water after radiation by the radiator 1 being again circulated into the water jacket 4.

The cooling water flow passage circulating within the water jacket 4 further includes a bypass flow passage 8 and a heater flow passage 10. The bypass flow passage 8 serves to allow cooling water which has been warmed as a result of cooling the cylinder block 5 and the cylinder head 6 to again circulate into the water jacket 4 to thereby reduce variations in water temperature and water pressure. The heater flow passage 10 allows a circulation of cooling water between the water jacket 4 and a heater 9 for warming the automobile interior space in the cold.

On the other hand, the outlet flow passage 7 is provided with a cooling water control valve 11 for controlling the start or stop of the circulation of cooling water as well as the amount of circulation thereof. The radiator 1 is provided with a cooling fan 12 for cooling the cooling water lying within the radiator 1. Furthermore, cut valves 13 serving as switching means of the present invention are disposed at three positions, i.e., at the bypass flow passage 8, the heater flow passage 9 and the cylinder block outlet 5*a*.

The water pump 2, cooling water control valve 11, cooling fan 12 and cut valves 13 are connected to the ECM 14 to which is connected a water temperature sensor 15 for detecting the temperature of cooling water within the cylinder head 6.

Although not shown, to the ECM 14 are connected various detection means for detecting engine driving conditions such as the throttle opening, engine speed, engine intake air amount, braking force and brake operation time and vehicle speed.

The ECM 14 comprises not shown a CPU, a ROM storing therein a control program for the CPU and various parameters, a RAM for storing therein various data attendant on actions of the CPU, and an I/O device which includes an A/D converter and a D/A converter. The ECM 14 allows the RAM to act as a working memory on the basis of the program stored in the ROM and serves as control means and control objective temperature setting means of the present invention.

Figure 2:
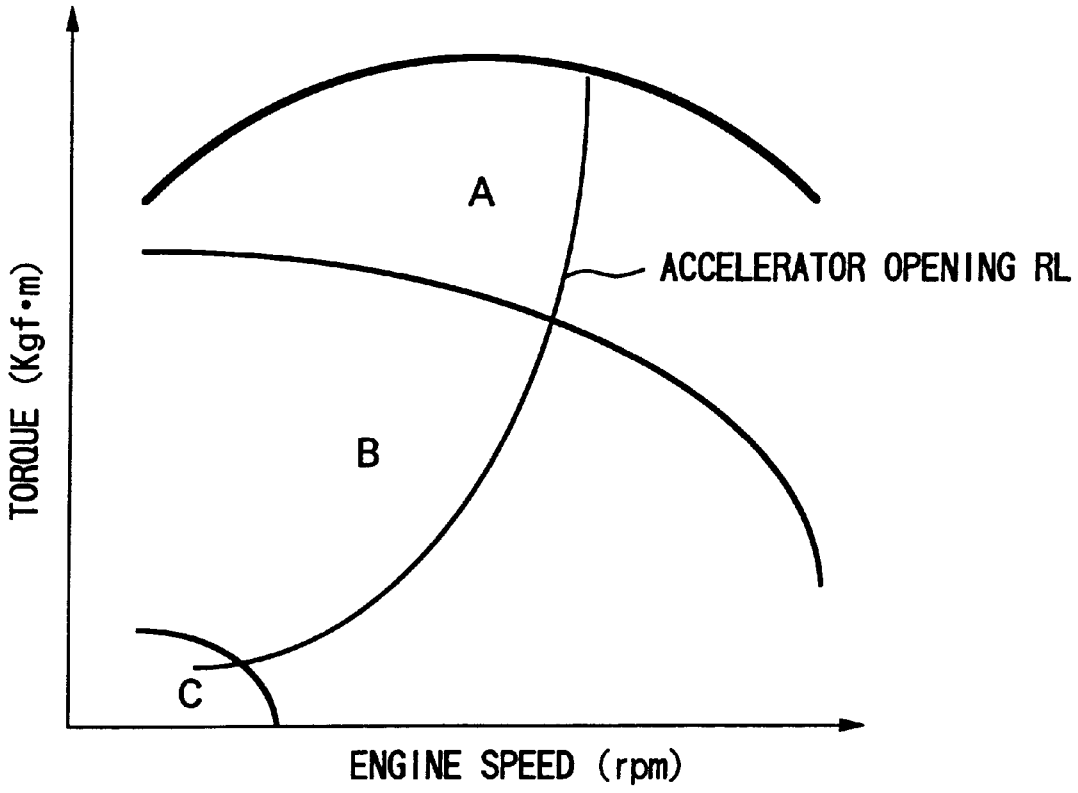
FIG. 2 illustrates a relationship among the engine speed, torque and accelerator opening in different engine driving conditions.

Referring to FIG. 2 there is illustrated a relationship among the engine speed, torque and accelerator opening (Road, load line: RL) in the respective engine driving conditions which are largely separated into regions A, B and C.

The region A is a one indicative of a high load condition in which the torque value is high relative to the engine speed with a large accelerator opening. The region B is a one indicative of a low load condition in which the torque value is lower than in the region A relative to the engine speed and in which the torque value decreases accordingly as the engine speed rises with a gently increased accelerator opening for a gentle acceleration. The region C is a one indicative of an idle condition in which there appears the lowest torque value relative to the engine speed with extremely small acceleration opening with little or substantially no variations.

In this embodiment the control objective temperatures in the engine driving conditions are set to 80, 110 and 95 degrees in centigrade for the regions A, B and C, respectively, with their data being stored in the ROM of the ECM 14.

Figure 3:
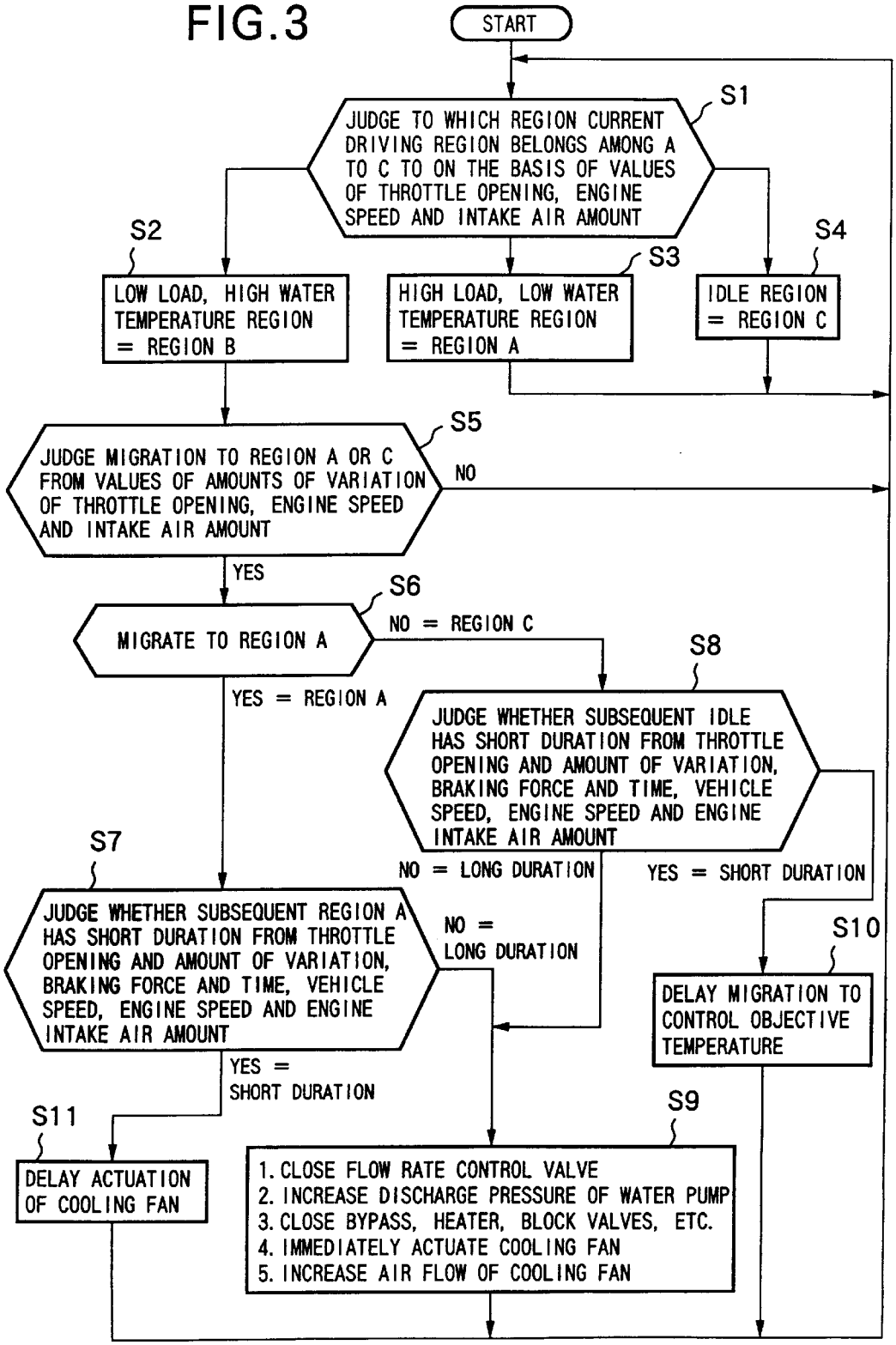
FIG. 3 is a flowchart showing a procedure for cooling water temperature control processing.
Figure 4:
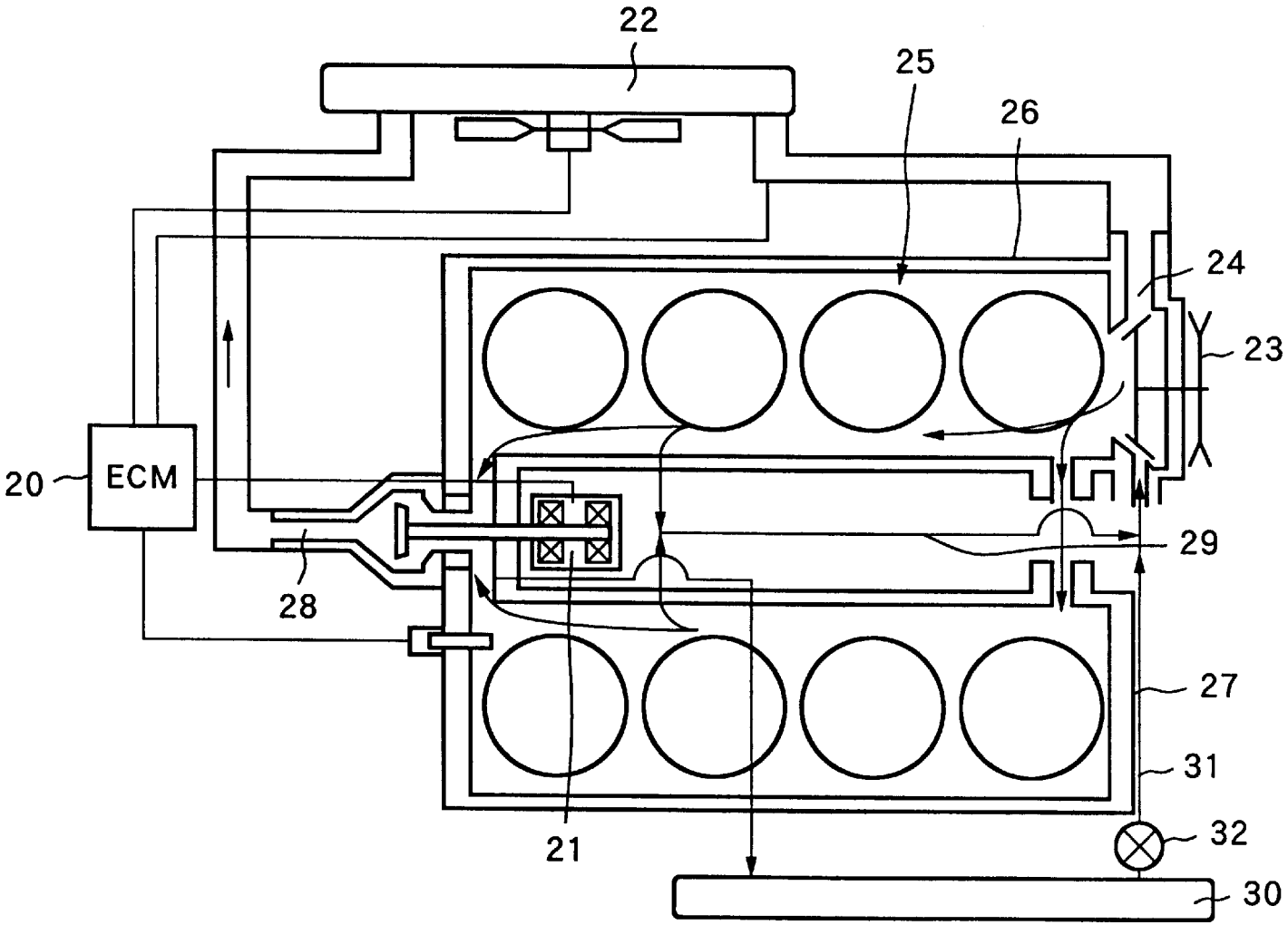
FIG. 4 illustrates a schematic configuration of a conventional engine cooling water control system.
Figure 5:
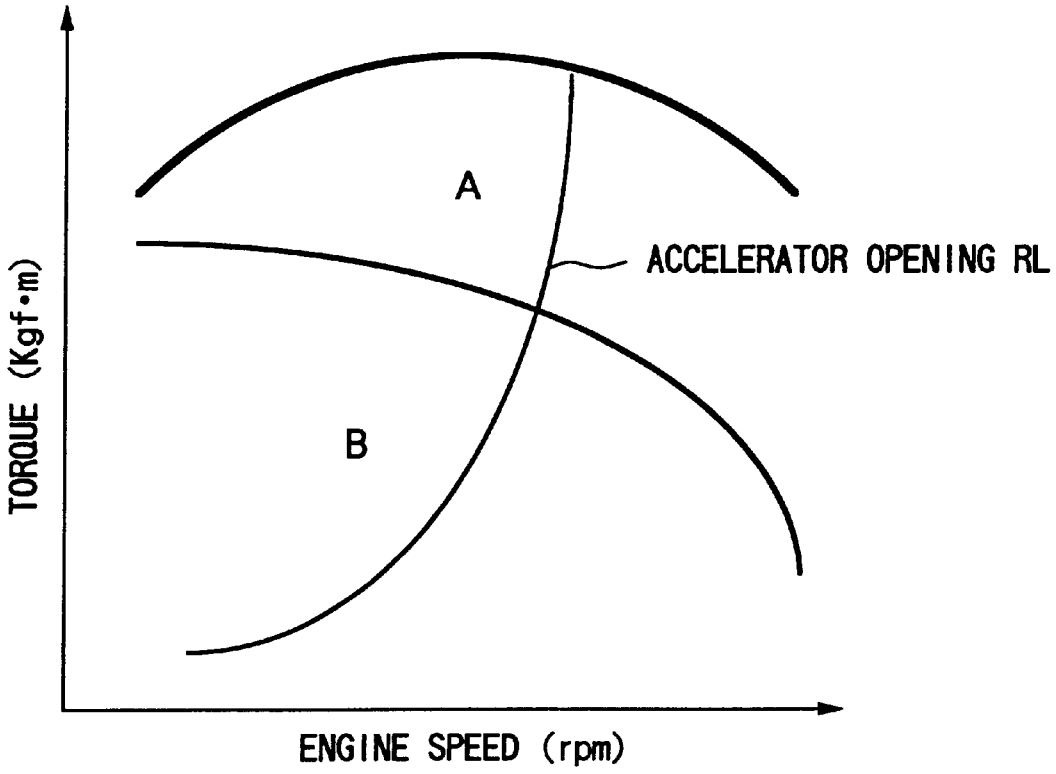
FIG. 5 illustrates a conventional relationship among the engine speed, torque and accelerator opening in different engine driving conditions.

Actions of the thus configured embodiment will be described with reference to FIG. 3 which is a flowchart showing a procedure of cooling water temperature control processing effected by the ECM 14.

In response to the on operation of an ignition switch, the ECM 14 starts to provide a control and judges to which region the engine driving condition belongs among the regions A (high load condition), B (low load condition) and C (idle condition) on the basis of values of the engine throttle opening, engine speed and engine intake air amount (S1). The ECM 14 then reads a control objective temperature corresponding to the result of judgment from the ROM and sets it to 80 degrees centigrade in case of the region A but to 95 degrees centigrade in case of the region C (S3, S4). The ECM 14 controls the amount of circulation of cooling water through the opening or closing of the cooling water control valve 11 to obtain that temperature.

On the contrary, in case it is judged in step S1 that the engine driving condition belongs to the region B (low load condition), the ECM 14 sets the control objective temperature to 110 degrees centigrade (S2). The ECM 14 then detects one or more of values of the engine throttle opening, engine speed and engine intake air amount or detects one or more of the amounts of variation of them and judges whether the engine driving condition migrates to the region A or C based on the result of detection (S5).

Furthermore, in case the result of judgment in step 5S is a migration to the region A (YES in S6), the CM 14 detects one or more of the throttle opening and the amount of variation thereof, braking force and brake operation time, vehicle speed, engine speed and engine intake air amount to judge whether the subsequent condition of the region A has a short duration on the basis of the result of detection (S7). More specifically, "short duration" is judged if conditions are satisfied that for example the vehicle speed is low (e.g., not higher than 20 km/hour) and the braking force is weak (or the number of times of operations of the brake per unit time is large) with a small throttle opening, whereas "long duration" is judged if the conditions are not fulfilled.

If it is judged herein that the condition of the region A has a long duration (NO in S7), then the cooling water control valve 11 is fully opened to allow a circulation of cooling water and the discharge pressure of the water pump 2 is increased with closing actions of the three cut valves 13 disposed at the bypass flow passage 8, heater flow passage 9 and cylinder block outlet 5*a*. Simultaneously, if the cooling fan 12 is inoperative at that time, the cooling fan 12 is actuated at once whereas if it is already in operation, the air flow of the cooling fan 12 is increased (S9).

Thus, by virtue of increase in the flow rate of the cooling water attendant on the full opening of the cooling water control valve 11 and increase in the flow rate of the cooling water attendant on the rise of the discharge pressure of the water pump 2, the cooling water within the engine is substituted by the cooling water within the radiator 1 in a brief duration. This enables the temperature within the engine to immediately lower to 80 or 95 degrees centigrade of control objective temperature. In addition, the full opening of the cooling water control valve 11 allows a relaxation of hunting phenomenon in which the cooling water temperature within the engine fluctuates.

At the same time, the closing actions of the cut valves 13 cut off the flow of cooling water through the bypass flow passage 8, with the result that it is prohibited that part of the cooling water warmed after cooling the cylinder block 5 and cylinder head 6 returns directly to the water jacket 4. Furthermore, cutting-off of the flow of the cooling water through the heater flow passage 10 prevents cooling water having a temperature closer to that of cooling water in the vicinity of the outlet flow passage 7 from returning to the interior of the water jacket 4. This means that factors in rise of the cooling water temperature within the engine can be reduced.

Furthermore, cutting-off of the flow of the cooling water at the cylinder block outlet 5*a* ensures an effective cooling of the cylinder head 6 having larger heating values than the cylinder block 5. It is therefore possible to immediately lower the cooling water temperature within the engine to the control objective temperature, 80 or 95 degrees centigrade. That is, a good responsibility is achieved upon the switching control of the cooling water temperature within the engine to the low temperature side.

If the judgment in step S7 results in YES, that is, it is judged that a return of the condition from the region A to the region B is achieved in a short time without allowing a longtime acceleration during the travel through the city area, the action of the cooling fan 12 of the radiator 1 is delayed by a predetermined time (S11).

This allows the cooling water within the water jacket 4 to be recirculated into the water jacket 4 without being cooled by the radiator 1, thereby keeping the cooling water temperature within the engine at a high temperature state. Thus, in case a return to the steady travel is achieved immediately after the short-time acceleration of the engine, that is, in case an immediate return of the engine driving condition from the region A to the region B is achieved, it is possible to reduce the response time upon the return of the cooling water temperature within the engine to 110 degrees centigrade without allowing meaningless cooling of the engine. In other words, a good responsibility is assured upon the switching control of cooling water temperature within the engine to the high temperature side. It is to be noted that the above-described predetermined time for the delay of the action of the cooling fan 12 is an acceleration time within the region A, e.g., 2 seconds, taken to reach the regulated maximum vehicle speed, which is forecast during the travel through the city area.

On the contrary, if the judgment in step S6 results in NO with the judgment of migration of the engine driving condition from the region B (low load condition) to the region C (idle condition), detection is further made of one or more of the throttle opening and the amount of variation thereof, braking force and time, vehicle speed, engine speed and engine intake air amount, to judge whether the subsequent condition of the region C has a short duration on the basis of the result of detection (S8). More specifically, "short duration" is judged if conditions are satisfied that for example the vehicle speed is low (e.g., not higher than 20 km/hour) with a weak braking force (or a large number of times of operations of the brake per unit time), whereas "long duration" is judged if the conditions are not fulfilled.

Then, if the short duration is judged, that is, if it is judged that the condition returns from the region C to the region B in a brief duration during the travel through the city area (YES in S8), switching to the control objective temperature in the region C is delayed by a predetermined time (S10). By virtue of this, there is maintained for a predetermined time the state in which the engine driving condition belongs to the region C but the control objective temperature is set to 110 degrees centigrade which is the control objective temperature in the region B.

Thus, in case the engine driving condition is returned immediately from the region C to the region B, the engine is prevented from being subjected to unnecessary cooling, making it possible to reduce the response time upon the return of the cooling water temperature within the engine to 110 degrees centigrade. In other words, a good responsibility is assured upon the switching control of the cooling water temperature within the engine to high temperature side. It is to be noted that the above-described predetermined time for the delay of switching to the control objective temperature in the region C is a time, e.g., about 5 seconds, taken from the travel condition at the maximum vehicle speed to the stop, which is forecast during the travel through the city area.

Alternatively, if the judgment in step S8 results in NO with the condition of the region C having a long duration, switching to the control objective temperature in the region C is immediately carried out, simultaneously performing the processing of the step S9 described above. As a result of this, it is possible to lower the cooling water temperature within the engine at once.

Thus, in this embodiment the control objective temperature in case of the engine driving condition in the idle condition (region C) has been provided separately from that of the high load condition (region A) and low load condition (region B), thereby making it possible to provide a control of the cooling water temperature within the engine, which is more suitable for each engine driving condition. Therefore, there can be improved the responsibility upon the switching control of the cooling water temperature within the engine, depending on the engine driving conditions. This contributes to an improvement in the fuel efficiency without impairing the engine power.

Furthermore, the differences in the control objective temperature between the idle condition and the high load condition and between the low load condition and the idle condition are smaller than the difference in the control objective temperature between the low load condition and the high load condition. This provides a prompt control of switching of the cooling water temperature within the engine to the control objective temperature between the idle condition and the high load condition or low load condition, as compared with the switching between the low load condition and the high load condition.

Although in this embodiment the control objective temperature in the idle condition has been set to a temperature lying between the control objective temperature in the low load condition and the control objective temperature in the high load condition, it may be set to the same temperature as the control objective temperature in the low load condition or as the control objective temperature in the high load condition. It is to be appreciated that by providing a low temperature control in which the control objective temperature in the idle condition is set to a lower temperature (95 degrees centigrade) than the control objective temperature (110 degrees centigrade) in the low load condition as in this embodiment, it is possible to reduce heat loads on the engine parts and to achieve an improvement in the heat resistance.

Although there has been shown one in which the switching of the control objective temperature is delayed in accordance with the result of judgment of the subsequent duration of the idle condition upon the migration from the low load condition to the idle condition, the switching of the control objective temperature may be delayed without judging the subsequent duration of the idle condition.

Although there has been shown one in which the actuation of the cooling fan is delayed in accordance with the result of judgment of the subsequent duration of the high load condition upon the migration from the low load condition to the high load condition, the actuation may be delayed without judging the subsequent duration of the high load condition.

Although the processing in step S9 has been effected in accordance with the result of judgment of the subsequent duration of the high load condition upon the migration from the low load condition to the high load condition or in accordance with the result of judgment of the subsequent duration of the idle condition upon the migration from the low load condition to the idle condition, the processing may directly be performed without judging the duration of the high load condition or the duration of the idle condition. Alternatively, the processing in the step S9 may be carried out only upon the migration from the low load condition to the high load condition, or the processing in the step S9 may be carried out only upon the low load condition to the idle condition.

Although the cut valves 13 have been shown disposed at three positions in the bypass flow passage 8, the heater flow passage 10 and the cylinder block outlet 5*a*, the cut valve 13 may be disposed at any one or two positions of the three positions so as to allow the closing action as needed as set forth hereinabove. In this case as well, there can be obtained the same effect as in the above embodiment.

Unlike the engine cooling water control system of this embodiment, an engine cooling water control system allowing a circulation of cooling water from the cylinder block to the cylinder head may be provided with cut valves disposed in the bypass flow passage and the heater flow passage, whereby similar effects can be achieved through the actuation of the cut valves.

As set forth hereinabove, in the invention as defined in claim 1, more control objective temperatures are set than in the prior art, so that it is possible to provide a control of the engine cooling water temperature adapted for the various engine driving conditions. Thus, there can be improved a responsibility upon the switching control of the cooling water temperature within the engine in conformity with the engine driving conditions. As a result of this, fuel efficiency can be improved without impairing the engine power.

Moreover, the control objective temperature in the idle condition which may often occur can be suppressed lower than in the prior art, so that it is possible to reduce the heat load on the engine parts with an improvement in the heat resistance.

In the invention as defined in claim 2, upon the switching of the cooling water control objective temperature within the engine from the first control objective temperature to the second control objective temperature, the flow rate control valve is fully opened so that cooling water within the engine can be substituted by cooling water within the radiator in a brief time. It becomes thus possible to further improve a responsibility upon the switching control of the cooling water temperature within the engine to the lower temperature, with more relieved hunting phenomenon.

In the invention as defined in claim 3, upon the switching of the cooling water control objective temperature within the engine from the first objective temperature to the second objective temperature, the discharge pressure of the water pump is increased than before so that cooling water within the engine can be substituted by cooling water within the radiator in a brief time. This also ensures a further improvement in a responsibility upon the switching control of the cooling water temperature within the engine to the lower temperature, as well as more relieved hunting phenomenon.

In the invention as defined in claim 4, cooling water flowing into the water jacket is kept at a low temperature immediately after the setting of the control objective temperature to the lower temperature side. This also ensures a further improvement in a responsibility upon the switching control of the cooling water temperature within the engine to the lower temperature.

In the invention as defined in claim 5, cooling water flowing into the water jacket is kept at a low temperature immediately after the setting of the control objective temperature to the lower temperature side, so that it is possible to further improve the responsibility upon the switching control of the cooling water temperature within the engine to the lower temperature side.

In the invention as defined in claim 6, when the control objective temperature is set to the lower temperature side, the flow of cooling water is cut off at the cylinder block outlet so that the cylinder head having a larger heating value is fully cooled down with increased engine cooling capacity. This contributes to a further improvement in the responsibility upon the switching control of the cooling water temperature within the engine to the lower temperature side.

In the invention as defined in claim 7, when the control objective temperature of the internal combustion engine is switched to a lower temperature, the air flow of the cooling fan provided in the radiator is increased so as to be able to promote the lowering in temperature of the cooling water circulating between the engine and the radiator. It is thus possible to compulsorily lower the cooling water temperature within the engine after mixing, as compared with the case where the cooling water temperature is gradually lowered only by the cooling effect of the radiator after the mixing of cooling water within the engine and cooling water within the radiator, whereby there can be achieved a further improvement in the responsibility upon the switching control of the cooling water temperature within the engine to the lower temperature side.

In the invention as defined in claim 8, during the initial stage after the migration of the engine driving condition from the low load condition to the high load condition, cooling water within the water jacket is recirculated into the water jacket without being cooled down by the radiator so that the cooling water within the engine is kept at a high temperature.

This prevents the engine from being subjected to useless cooling when the engine driving condition is returned immediately from the high load condition to the low load condition, thereby making it possible to shorten the response time upon the return of the cooling water temperature within the engine to the first control objective temperature. As a result of this, there can be achieved a further improvement in the responsibility upon the switching control of the cooling water temperature within the engine.

In the invention as defined in claim 9, during the initial stage after the migration of the engine driving condition from the low load condition to the idle condition, the temperature of the engine cooling water is controlled to the first control objective temperature so as to allow a delay of lowering of the cooling water temperature within the engine.

Thus, the engine is prevented from being subjected to useless cooling when the engine driving condition is returned at once from the high load condition to the low load condition, thereby making it possible to reduce the response time upon the return of the cooling water temperature within the engine to the first control objective temperature. As a result of this, there can be achieved a further improvement upon the switching control of the cooling water temperature within the engine.

What is claimed is:

1. An engine cooling water control system for controlling the temperature of cooling water within an engine to a control objective temperature through a circulation of said cooling water between a radiator and said engine, said cooling water control system comprising control objective temperature setting means for setting said control objective temperature of said cooling water within said engine to a first control objective temperature when the driving condition of said engine is a low load condition, and to a second control objective temperature lower than said first objective temperature when the driving condition of said engine is a high load condition, and to a third control objective temperature lying between said second control objective temperature and said first control objective temperature when the driving condition of said engine is an idle condition.

2. The engine cooling water control system according to claim 1, further comprising:

a flow rate control valve for controlling the flow rate of cooling water circulating between said radiator and said engine; and control means for controlling the opening of said flow rate control valve so as to achieve a control objective temperature which is set by said control objective temperature setting means, said control means providing a control to fully open said flow rate control valve when said control objective temperature is set to said second objective temperature by said control objective temperature setting means.

3. The engine cooling water control system according to claim 1, further comprising:

a water pump allowing a circulation of said cooling water and capable of controlling its discharge pressure; and control means for increasing the discharge pressure of said water pump than before when said control objective temperature is set to said second objective temperature by said control objective temperature setting means.

4. The engine cooling water control system according to claim 1, further comprising:

opening/closing means for opening or closing a bypass flow passage allowing a recirculation into a water jacket of said engine of a part of cooling water which is returned to said radiator after cooling of the interior of said water jacket; and control means for causing a closing action of said opening/closing means when said engine driving condition migrates from a low load condition to a high load condition or to an idle condition.

5. The engine cooling water control system according to claim 1, further comprising:

opening/closing means for opening or closing a heater flow passage allowing a circulation between a water jacket and a heater of said engine; and control means for causing a closing action of said opening/closing means when said engine driving condition migrates from a low load condition to a high load condition or to an idle condition.

6. The engine cooling water control system according to claim 1, further comprising:

a cylinder block and a cylinder head which communicate with each other and constitute a water jacket of said engine;

a cylinder block outlet disposed in said cylinder block for allowing a return of interior cooling water to said radiator;

a cylinder head outlet disposed in said cylinder head for allowing a return of interior cooling water to said radiator;

opening/closing means for opening or closing said cylinder block outlet; and control means for causing a closing action of said opening/closing means when said engine driving condition migrates from a low load condition to a high load condition or an idle condition.

7. The engine cooling water control system according to claim 1, further comprising:

control means for increasing air flow of a cooling fan of said radiator when said engine driving condition migrates from a low load condition to a high load condition or to an idle condition.

8. The engine cooling water control system according to claim 1, further comprising:

control means for delaying the action of a cooling fan of said radiator when said engine driving condition migrates from a low load condition to a high load condition or to an idle condition.

9. The engine cooling water control system according to claim 1, further comprising:

control means for delaying the action of setting of said control objective temperature to said third control objective temperature effected by said control objective temperature setting means when said engine driving condition migrates from a low load condition to an idle condition.

* * * * *